US007681269B2

(12) United States Patent
Biggie et al.

(10) Patent No.: US 7,681,269 B2
(45) Date of Patent: Mar. 23, 2010

(54) SUPPORT SURFACE WITH INTEGRAL PATIENT TURNING MECHANISM

(75) Inventors: Lydia B. Biggie, Coral Springs, FL (US); John Gillis, Coral Springs, FL (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 67 days.

(21) Appl. No.: 11/308,976

(22) Filed: Jun. 1, 2006

(65) Prior Publication Data

US 2007/0143928 A1 Jun. 28, 2007

Related U.S. Application Data

(60) Provisional application No. 60/595,052, filed on Jun. 1, 2005.

(51) Int. Cl.
*A47C 27/10* (2006.01)

(52) U.S. Cl. ..... 5/715; 5/713; 5/709

(58) Field of Classification Search ..... 5/715, 5/713, 710, 706, 655.3, 654, 644, 615, 709
See application file for complete search history.

(56) References Cited

U.S. PATENT DOCUMENTS

| | | | | | |
|---|---|---|---|---|---|
| 1,772,310 | A * | 8/1930 | Hart | 5/713 |
| 4,697,290 | A * | 10/1987 | Alklind et al. | 5/632 |
| 4,934,002 | A * | 6/1990 | Watanabe | 5/607 |
| 5,611,096 | A * | 3/1997 | Bartlett et al. | 5/617 |
| 5,794,289 | A * | 8/1998 | Wortman et al. | 5/713 |
| 5,926,883 | A * | 7/1999 | Rechin et al. | 5/706 |
| 5,966,762 | A * | 10/1999 | Wu | 5/710 |
| 6,061,855 | A * | 5/2000 | Flick | 5/713 |
| 6,119,292 | A * | 9/2000 | Haas | 5/715 |
| 6,145,142 | A * | 11/2000 | Rechin et al. | 5/706 |
| 6,353,950 | B1 * | 3/2002 | Bartlett et al. | 5/617 |
| 6,370,716 | B1 * | 4/2002 | Wilkinson | 5/715 |
| 6,493,888 | B1 * | 12/2002 | Salvatini et al. | 5/423 |
| 6,604,252 | B1 * | 8/2003 | Lee et al. | 5/715 |
| 6,708,352 | B2 * | 3/2004 | Salvatini et al. | 5/423 |
| 6,718,584 | B2 * | 4/2004 | Rabaiotti et al. | 5/715 |
| 6,739,001 | B2 * | 5/2004 | Flick et al. | 5/425 |
| 6,892,405 | B1 * | 5/2005 | Dimitriu et al. | 5/615 |
| 7,007,330 | B2 * | 3/2006 | Kuiper et al. | 5/715 |
| 7,418,751 | B1 * | 9/2008 | Bartlett et al. | 5/609 |
| 7,434,283 | B2 * | 10/2008 | Wilkinson et al. | 5/713 |
| 2002/0133877 | A1 * | 9/2002 | Kuiper et al. | 5/81.1 R |
| 2002/0144343 | A1 * | 10/2002 | Kuiper et al. | 5/81.1 R |
| 2002/0170117 | A1 * | 11/2002 | Flick et al. | 5/715 |
| 2003/0084511 | A1 * | 5/2003 | Salvatini et al. | 5/423 |
| 2005/0125905 | A1 * | 6/2005 | Wilkinson | 5/713 |
| 2005/0177952 | A1 * | 8/2005 | Wilkinson et al. | 5/713 |
| 2006/0117490 | A1 * | 6/2006 | Hung et al. | 5/715 |
| 2007/0143928 | A1 * | 6/2007 | Biggie et al. | 5/715 |
| 2007/0266499 | A1 * | 11/2007 | O'Keefe et al. | 5/713 |
| 2008/0028534 | A1 * | 2/2008 | Wilkinson | 5/713 |

* cited by examiner

*Primary Examiner*—Robert G Santos
(74) *Attorney, Agent, or Firm*—Nixon & Vanderhye P.C.

(57) ABSTRACT

A unique support surface that provides a controllable inflation system, and a turning bladder structure for turning a patient quickly for the application of a nursing protocol. The support surface includes air cell arrays and turning bladders which are used to turn the patient in either direction under control of the medical practitioner. The air cell arrays can be arranged longitudinally or laterally. The multiple turning bladders are preferably formed with a unique butterfly shape that minimizes the amount of air required to inflate, which then results in high-speed turning of the patient.

9 Claims, 5 Drawing Sheets

SUPPORT SURFACE WITH INTEGRAL PATIENT TURNING MECHANISM

CROSS-REFERENCE TO RELATED APPLICATIONS

This application is related to, and claims the benefit of, the provisional patent application entitled "Support Surface With Integral Patient Turning Mechanism", filed Jun. 1, 2005, bearing U.S. Ser. No. 60/595,052 and naming Lydia Biggie, and John Gillis, the named inventors herein, as sole inventors, the contents of which is specifically incorporated by reference herein in its entirety.

BACKGROUND OF THE INVENTION

1. Technical Field

The present invention relates to patient support surfaces. In, particular, it relates to a patient support surface which has integral air cell arrays which allow medical personnel to rapidly turn a patient for providing various types of patient care and treatment.

2. Background

Caring for patients in the hospital or other medical environment often requires that the patient be rotated or turned so that treatments and medications can be applied to various parts of the patient's body. Every patient requires some sort of nursing protocol (changing wound dressings, bathing, applications of medications, examinations, getting the patient out of bed, etc.) which requires the movement and/or turning of the body. Unfortunately, most hospital facilities use either conventional mattresses, or support services, to support a patient's body while they are hospitalized. During the course of treatment, a nurse may be required to make several time-consuming trips per day to ensure that the patient is properly cared for and treated. Often, a nurse who may be much smaller than the patient is required to rotate the patient to apply treatment. It is difficult to move or turn patients who are lying on a conventional mattress or support surface. This can be uncomfortable for the patient, and create problems for the nurse who may have difficulty moving a larger (e.g., bariatric) patient.

A support surface by design is a mattress made up of air (and/or foam) which is soft and which moves or changes shape with patient movement. Moving a patient on a support surface such as this is especially difficult if the patient is large. There is also a possibility of injury to both the patient and the nurse if a nurse tries to manually turn a patient. Frequently, there is a tendency is to pull on the patient's arms to move the torso, or push on the patient's back. This causes strain on portions of the patient's body as well as on the nurse's back. It would be desirable if a patient could be easily turned without requiring excessive physical activity on the part of nurses or other medical practitioners, and without unnecessary discomfort to the patient. Further, it would be desirable to provide the nurse the ability to control the rapid turning of a patient for nursing protocols.

In addition to the physical difficulties associated with rotating patients, the medical practitioner's time is also a concern. For example, a medical practitioner such as a nurse has numerous patients to care for and cannot devote excessive amounts of time to a particular patient. In addition, the medical facility also has an interest in maximizing time efficiency for the purpose of keeping costs low.

Therefore, there would be an important benefit to medical care industry if a method could be devised to allow a nurse or other medical practitioner to quickly turn a patient for the purpose of providing medical care and/or treatment. Further, nurses cannot wait very long while the patient is being turned, as they need to start procedures as quickly as possible due to nursing workloads.

There are support surfaces on the market which continuously turn the patient for therapy (lateral rotation). These support surfaces are designed for patients with pulmonary complications and also to alternate pressure on the patient's body for the purpose of avoiding bedsores and other undesirable side effects of prolonged bed rest. They do not have a nurse controllable quick turn feature to allow a patient to be turned as needed for the application of medical treatment protocols.

SUMMARY OF THE INVENTION

The present invention provides a unique support surface structure which allows for conventional alternating pressure or continuous low pressure (float or static), but in addition, provides a controllable inflation system for the unique support surface for turning a patient quickly for the application of a nursing protocol. The support surface includes air cell arrays and turning bladders used to turn the patient in either direction under control of the medical practitioner. The air cell arrays can be arranged longitudinally or laterally. The multiple turning bladders are preferably formed with unique butterfly shape that minimizes the amount of air required to inflate, which results in high-speed turning of the patient.

DESCRIPTION OF THE PREFERRED EMBODIMENT

Figure 1:
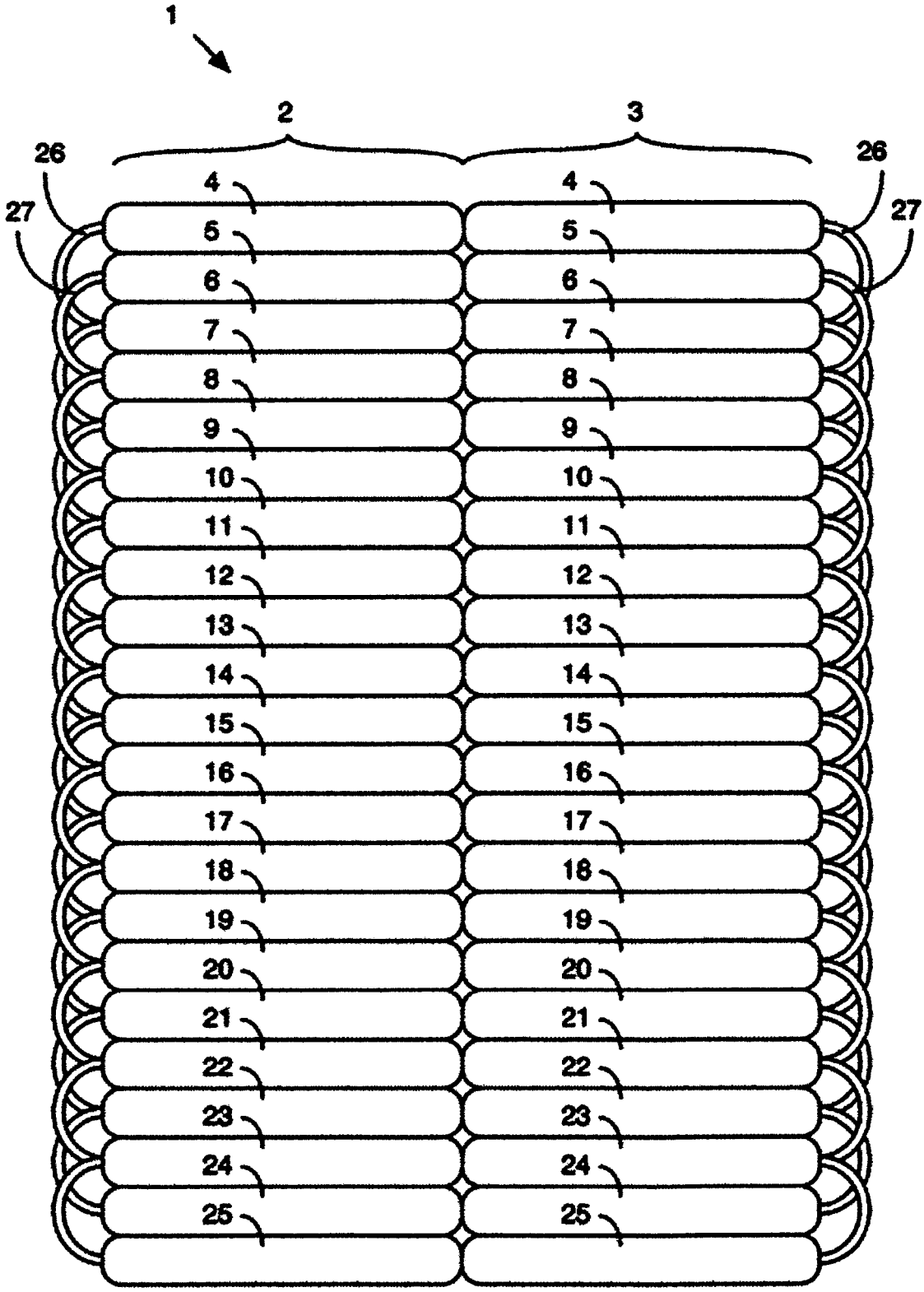
FIG. 1 shows a top view of a preferred embodiment of the air cell array.

Prior to a detailed discussion of the figures, a general overview of the system will be presented. This invention provides a unique support surface whose inflation is controlled by a medical practitioner. The medical practitioner controls air cell array sets 2, 3 and turning bladders 37, 38 which allow the patient to be rotated/turned on a bed without manual rotation by the nurse or medical practitioner. In addition, this invention can perform the functions of a conventional support surface, such that when the air cell array sets 2, 3 and turning bladders 37, 38 are not being used to rotate the patient, the support surface can be used to provide conventional therapy, such as alternating pressure, etc.

The features of the support surface are as follows:

1-The Air Cell Array

In the preferred embodiment, the air cell array 1 typically consists of approximately 16 to 22 air cell array segments in each of a right and left air cell array sets 2, 3. The air cell array 1 is preferably arranged such that adjacent segments of air cell array sets 2, 3 extend laterally across the top of the support surface. Those skilled in the art will recognize that any suitable number of air cell array segments 4-25 can be used, depending on the design of a particular support surface. Likewise, the air cell array segments 4-25 can also be fabricated such that they extend longitudinally rather than laterally.

In the preferred embodiment, air cell array sets 2, 3 can provide alternating pressure, float, static, or continuous low pressure. For example, air cell array segments 4, 6, 8, et seq., would be connected together while air cell array segments 5, 7, 9, et seq., are connected together. Pressure in these groups of air cell array segments can be controlled or varied to provide a support surface to be used as a conventional alternating pressure mattress, as a float mattress, or as a static mattress. However, in contrast to prior art alternating pressure mattresses, each air cell array 1 is divided into at least 2 parts, and forms adjacent sets of air cell array sets which are arranged longitudinally on the support surface. For example, a left or right set of air cell array sets 2, 3 would be arranged longitudinally, and would be independently inflatable or deflatable. Therefore, air cell array sets 2, 3 would be independently inflatable or deflatable from one another. Likewise, air cell array segments 4, 6, 8, et seq. are connected and air cell array segments 5, 7, 9, et seq. are connected in the same manner. If each air cell array segment 2, 3 is divided into more than two sections, for example 3 sections, the center section 4, 6, 8, et seq. are connected and 5, 7, 9, et seq. are connected.

The purpose of dividing the air cells into at least 2 zones (air cell array sets 2, 3) is that the air cell pressure on the right side of the mattress can be controlled independently from the air cell pressure on the left side of the mattress. This is important for the operation and optimum turn rate when utilizing the turning bladders 37, 38 for quickly turning a patient.

In an alternate preferred embodiment, the air cell array 1 can have the individual air cells array segments 4-25 arranged longitudinally and running the length of the support surface. In this configuration, there would normally be fewer cells than the original version. However, the longitudinal cells would also have zones. For example if there were 8 cells, the right 3 would be connected together, the center 2 would be connected together, and the left 3 would be connected together. This way the right or left sides could deflate for a turn to the right or left, while the opposite side would stay inflated. Center air cells could be deflated or stay inflated, depending on the comfort or size of the patient.

Another alternative preferred embodiment uses two air cell arrays. In this embodiment, the air cell arrays are positioned one on top of another. They can also be oriented such that one air cell array has its air cell segments arranged laterally, while the other air cell array has its air cell segments arranged longitudinally. The advantage of using dual air cell arrays is that it allows a greater rotation angle to be reached when rotating a patient.

When a nurse desires to turn a patient, the nurse simply activates the appropriate air pressure controls, such that one side of the support surface is deflated while the other is inflated, and the patient is turned by gravity rather than through the physical effort of the nurse. This feature can be very valuable, since a single, or even two, medical practitioners may find it very difficult to rotate a bariatric patient.

2-Turning Bladders

In the preferred embodiment, left and right turning bladders are located under the air cell array 1. When the left turning bladder 37 is inflated, the right side of the air cell array 1 is deflated. Likewise, when the right turning bladder 38 is inflated, the left side of the air cell array 1 is deflated. The combination of the inflated air cell array set 2 and turning bladder 37 on one side of the support surface and the deflated air cell array set 3 and turning bladder 38 on the other side of the support surface makes it possible to obtain a maximum degree of turn for the patient. It is important to achieve a maximum turn of approximately 40 to 50 degrees to allow the nurse to reach the patient's side or partial back, or to get the patient out of bed. In the preferred embodiment, some of the turning motion is generated by the air cell array 1 which is used in combination with the turning bladders 37, 38. This provides an advantage, because it allows the actual volume of the turning bladders 37, 38 to be smaller. With a smaller volume, the turning bladders 37, 38 fill more rapidly, and turn the patient faster. Likewise, the associated air cell sets 2, 3 on the other side of the support surface can be deflated simultaneously to increase rotational speed.

Those skilled in the art will recognize that while the preferred embodiment places the left and right turning bladders 37, 38 under the air cell array 1, they could also be located on top of the air cell array 1. However, those skilled in the art will recognize that this alternative embodiment would interfere with the provision of alternating pressure therapy by the air cell array 1.

It is possible to have a turning bladder 37, 38 with a single wing on each side of the support surface. However, the preferred embodiment uses multiple turning bladder wings to accommodate bed configurations in which the support surface does not lie on a single plane. For example, by using two turning bladder wings on each side of the support surface, the support surface provides the advantage of being able to turn the patient even when the patient is in an inclined (head up) position (known as the Fowler position). Most patients, in fact, do not lie flat, but always have some angle of inclination. Even in the most angled Fowler position, the multiple bladder wing configuration allows the patient to be turned, or assisted out of bed. In the preferred embodiment, the two turning bladder wings 29-32 on each side of the support surface have shell shapes that are connected by air pathways 33, 34. The air pathways 33, 34 can bend without blocking air, allowing the turn function to work at all Fowler angles. Other possible designs of turning bladders 37, 38, such as turning bladders having a tubular or rectangular shape, do not lend themselves to being as easily bent lengthwise as the shell design used by the preferred embodiment.

In the preferred embodiment, the air cell array 1 is normally inflated on both sides (left and right) when, the patient is not being turned, but resting on the therapeutic surface under either alternating pressure or float support. To turn a patient, only the turning bladders need to be inflated or deflated. The smaller the turning bladder, the quicker it will inflate, and the quicker the patient will be turned. However, there is a trade off in that the smaller the turning bladder, the less of a degree of turn is achieved. This is where the specific design of the turning cell is important.

In this invention, the design of the turning cell takes several things into consideration: first, the interplay between the actual volumes which are required to be inflated, and the desired height of the inflated cell, and second, the issue of entrapment.

In regard to the issue of balancing rotation speed versus rotation angle, the taller the height of the turning bladder, the greater the turning angle. However, greater height also requires larger air volume, and the larger the air volume, the more time it will take to reach a full turn. As discussed above, the medical practitioner will get a greater benefit when the patient can be quickly turned since the medical practitioner can then use that time for the patient, or for another patient.

Regarding entrapment, entrapment could occur if the patient is lying on the far side of the bed, for example, to the right. If the patient is turned to the left, the right turning bladder is inflated. If the turning bladder does not extend from the center of the bed completely to the side, the patient could roll to the left and be trapped between the inflated cell and the side rail. In the preferred embodiment, the turning bladder is shaped to prevent the patient from entrapment on the "wrong" side of the turning bladder.

The shape that accomplishes the design criteria discussed above is similar to a butterfly. There are two "shell" shaped wings 29, 30 connected in the middle by a passageway 33 for the left turn bladder 37, and an identical configuration for the right turn bladder 38. The largest part of the inflated turn bladders 37, 38 is oriented toward the outside of the bed. This area fills in the section that could cause entrapment. The smaller (and lower inflated) section of the air cell is oriented toward the center. From the plane of the support surface, the turning bladder 37, 38 forms a wedge shape. The one "wing" 29, 31 of the butterfly shape closest to the head of the bed forces the shoulders to turn, and the other wing 30, 32 closest to the foot of the bed forces the hip area to turn.

Other shapes for turning bladders 37, 38 may be used, such as square, rectangular or even trapezoidal shapes. These designs will turn the patient, but the required air volume is considerably larger. As a result, it will take longer to fill the shapes using the same air source as this to fill the butterfly design used in the preferred embodiment of the invention. The butterfly design reduces the volume in the center (head to foot) of the turning bladders 37, 38, allowing for significantly less total volume which results in quick turns. However, it still achieves the same overall height for maximum turn angle. Further, since the butterfly shape is large enough to extend to the edge of the bed or even slightly beyond, entrapment possibility is significantly reduced.

As mentioned above, the two shell-shaped portions of the turning bladder 37, 38 are connected either by a hose, conduit, or passageway made out of the same material that the bladder is made of. Those skilled in the art will recognize that inflatable turning bladders 37, 38, as well as the rest of the support surface, can be made from any suitable material, such as polyethylene, polypropylene, rubber, plastic, urethane, vinyl, etc. These materials may be used alone, in combination with one another, or laminated, coated, or bonded to nylon or nylon equivalent materials to increase structural integrity and durability. In the preferred embodiment, the support surface is fabricated from flexible sheets of material which are not rigid. To ensure proper airflow, a semi-stiff open net-like material 35 is inserted into the passageways 33, 34 to keep the air channel open at all times. An example of a semi-rigid open weave material is Colbond™, made by Colbond, Inc. of Enka, N.C. It is a non-woven 3D polymeric structure. This material is selected because it is not too hard, as the patient will be lying on it during the turning procedure. It is also stiff enough not to collapse and open enough to allow air to flow freely.

The primary purpose of the invention is to have a therapeutic mattress that allows for conventional alternating pressure or float, yet under control of the nurse, it can quickly turn the patient for the nurse's convenience. In addition, with a modification to the programming/design of the air source, this same design can be used for lateral rotation (continuous rotation of the patient for pulmonary conditions) while at the same time providing pressure relief through alternating pressure of float therapy. The change would be the amount of time the patient is held on one side and degree of turn before being turned to the other side. The continuous turning would be done automatically versus a quick turn for nursing protocol controlled by the nurse and done automatically. This provides an enhanced support surface that has conventional features in addition to the high-speed turning feature provided by the invention. This allows the same equipment (i.e., the air pump, the programmable controller, etc.) to be used for multiple functions.

In addition to the basic elements of the preferred embodiment, the support surface also has optional side bolsters 41, which may he made out of foam or air cells. They extend the full length of the mattress at its edge, along the side rails. The purpose of the side bolsters 41 is to keep the patient positioned properly (avoid bumping into the side rail, sliding out of bed, or sliding and laying on only half the bed and not turning). These side bolsters are preferably taller than the height of the air cell array. This tends to gently cradle patients, keeping them away from the hard side rails.

Having discussed the support surface in general, we turn now to a more detailed discussion of the figures.

FIG. 1 shows a top view of a preferred embodiment of the air cell array 1. The air cell array 1 is divided into left and right air cell array sets 2, 3. Each air cell array set 2, 3 is divided into a series of laterally oriented air cell array segments 4-25. The even set of left and right air cell array segments 4, 6, 8, 10, 12, 14,16, 18, 20, 22, 24 are connected via air conduits 26, and the odd set of left and right air cell array segments 5, 7, 9, 11,13, 15,17, 19, 21, 23, 25 are connected via air conduits 27. By controlling the air supply 42 (shown in FIG. 2) with programmable controller 43, the air cell array segments 4-25 can be inflated and deflated to provide conventional alternating support. In addition, the air cell array segments 4-25 can be controlled to assist in the turning function.

Those skilled in the art will recognize that the number of laterally oriented air cells array segments 4-25 can vary, and can even be implemented as a single lateral air cell array segment 4 on either side of the air cell array 1. However, in the preferred embodiment, the number of laterally oriented air cell array segments 4-25 should be sufficient to provide alternating pressure in addition to rotation of the patient from one side to another.

Figure 2:
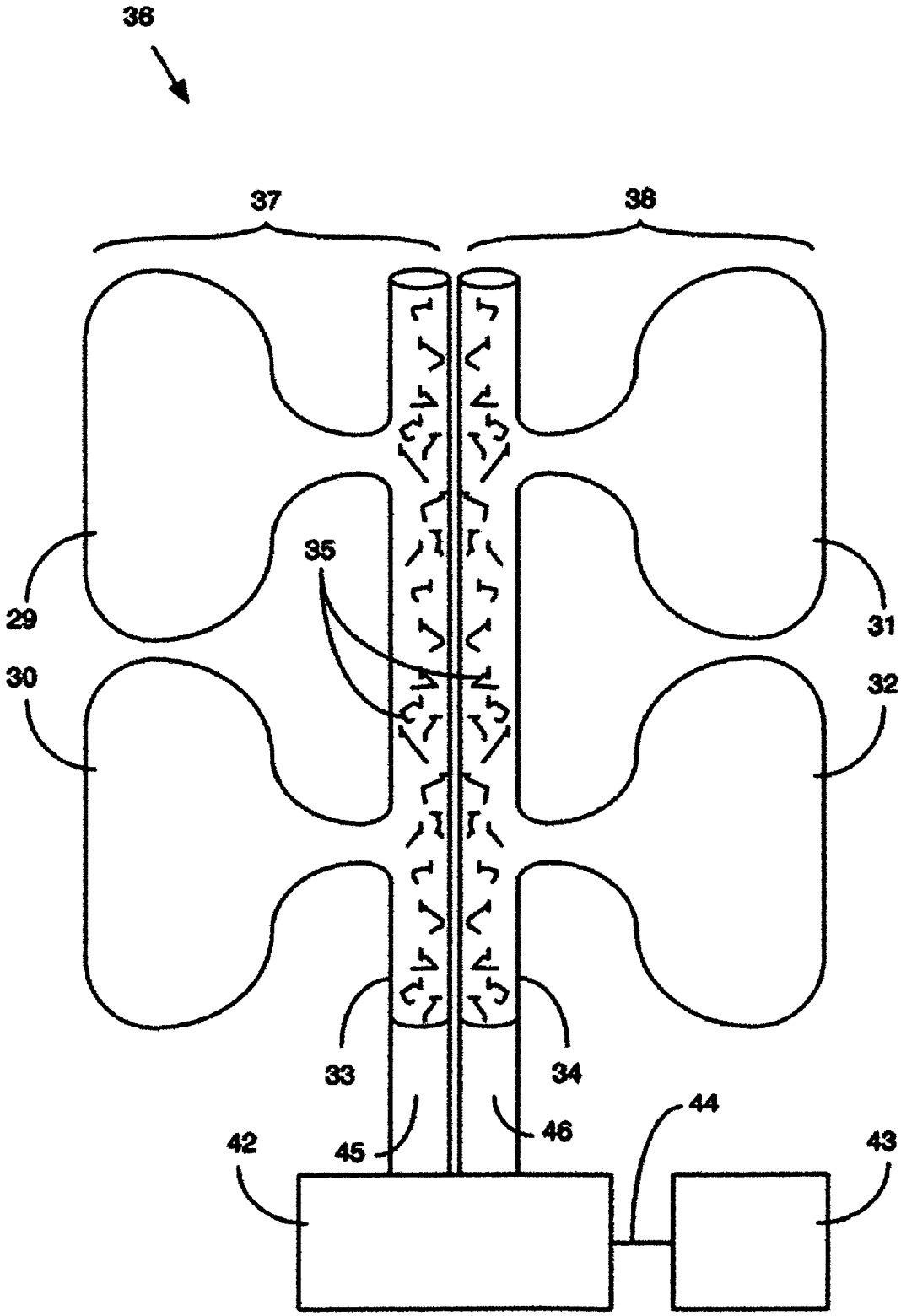
FIG. 2 is a top view of a preferred embodiment of a turning bladder.

FIG. 2 is a top view of a preferred embodiment of a turning bladder 36. Turning bladder 36 has left and right sides 37, 38 which can inflate and deflate independently of one another. Turning bladder 36 uses butterfly wings 29-32 to turn a patient. When wings 29-30 are inflated, wings 31-32 are deflated. To turn a patient in the opposite direction, wings 29-30 would be deflated and wings 31-32 would be inflated. Air pressure is provided by an air supply (not shown) via air passageways 33, 34. In the preferred embodiment, a semi-rigid open weave material 35 is placed in the air passageways 33, 34 to ensure that airflow is not obstructed.

For ease of discussion, turning bladder 36 is shown with a first pair of wings 29-30 on one side of the turning bladder 36 and a second pair of wings 31-32 on the other side of turning bladder 36. Those skilled in the art will recognize that the number of wings can vary to suit design objectives. The advantage of using multiple wings, as shown in FIG. 2, is that the wings provide a reduced inflatable volume in comparison to a single wing that runs the length of the turning bladder 36. This reduces the amount of air that needs to be provided to inflate the wings 29-32, which in turn increases the speed at which the patient may be turned.

In addition, this figure also illustrates air supply 42 which is attached to air passageways 33, 34 via conduits 45, 46. The air pressure applied to air passageways 33, 34 can be independently controlled by air supply 42. Air supply 42 can be any suitable commercially available air pump or pumps. In the preferred embodiment, air supply 42 also provides air pressure to air cell array 1.

Air supply 42 is controlled by controller 43 via control lines 44. Controller 43 can be implemented by a commercially available control unit, a personal computer, etc. Controller 43 is controlled by the medical professional who sets the commands in the controller 42 that control the inflation of the air cell array 1 and the turning bladder 36. Controller 43 can be a programmable device or a hardwired control unit.

For ease of illustration, air supply 42 and controller 43 are shown as separate units. However, those skilled in the art recognize that air supply 42 and controller 43 can be implemented as a single unit.

Figure 3:
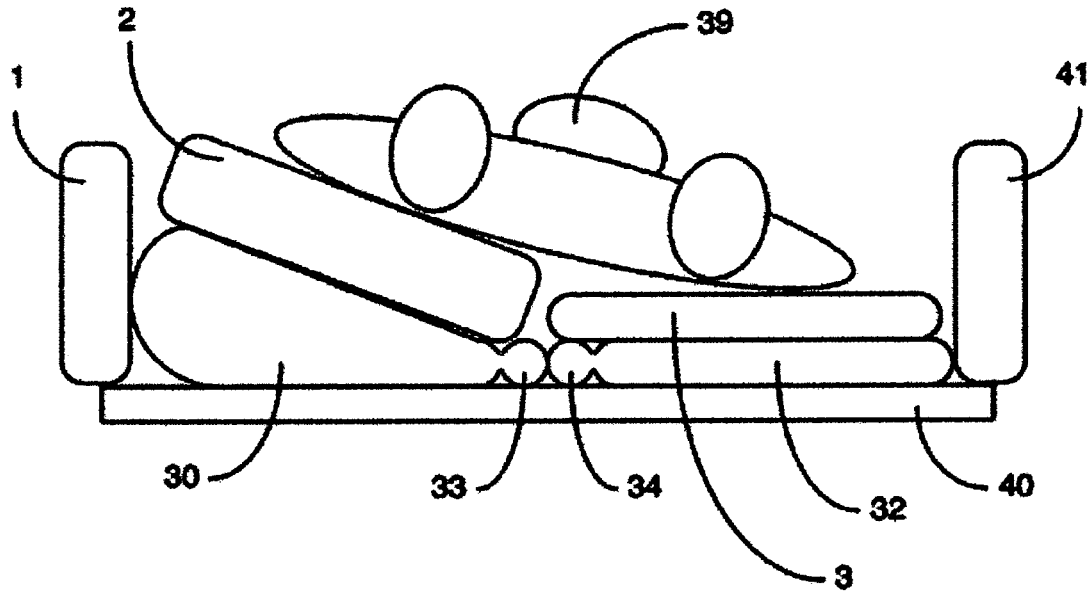
FIG. 3 is an end view of a preferred embodiment of the invention showing a turning bladder in the inflated state.

FIG. 3 is an end view of a preferred embodiment of the invention showing a turning bladder wing 30 in the inflated state, and resting on surface 40 with support bolsters 41 arranged on the edges of the support surface. The opposing turning bladder wing 32 is deflated. Likewise, the air cell array set 2 is inflated and the air cell array set 3 is deflated. As a result, the patient 39 is rotated. Those skilled in the art will recognize that the patient 39 can be rotated without varying the air pressure in air cell array sets 2-3. However, by coordinating the air pressure in air cell array sets 2-3 with the air pressure in turning bladder wings 29-32, the speed and amount of rotation can be increased.

Figure 4:
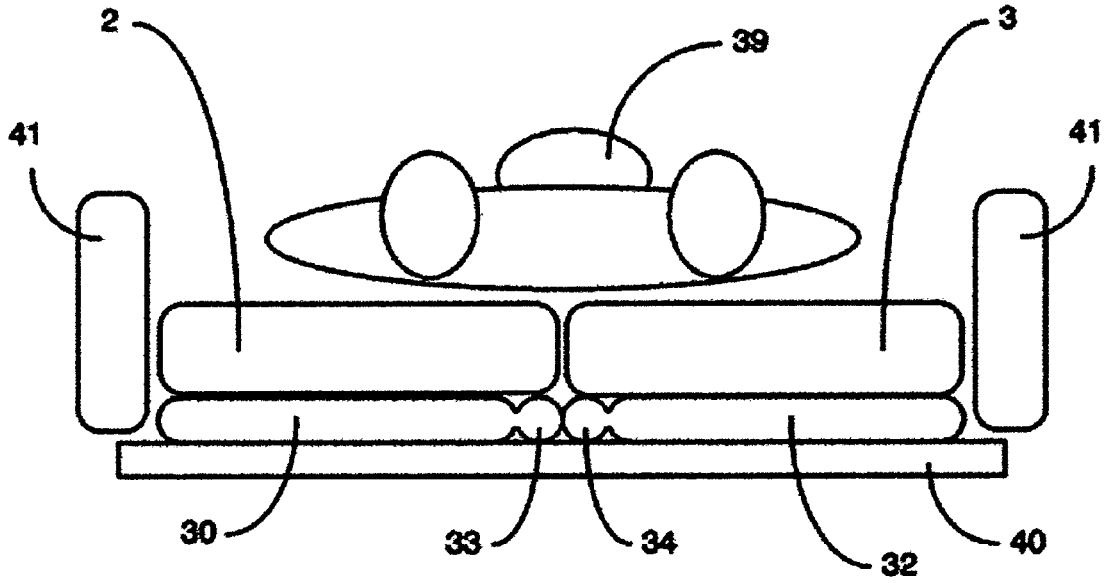
FIG. 4 illustrates an end view of a preferred embodiment of the invention showing the turning bladder in the deflated state.

FIG. 4 illustrates an end view of a preferred embodiment of the invention showing the turning bladder wings 30-32 in the deflated state. The air cell array sets 2, 3 are both inflated. As a result, the patient 39 will lay flat and not be rotated.

As can be seen from the foregoing, the invention provides a number of advantages. It provides a single support surface which can provide conventional functions such as alternating pressure, or float (e.g., static, continuous low pressure). In addition, it provides a new function which provides a rapid turn function to assist the nurse when administering nursing protocols. The rapid turn function is implemented with a novel turning bladder 36 that, in the preferred embodiment, has wings 29-32 shaped like a double butterfly to have the smallest volume of air possible for a quick turn, yet inflate enough to obtain up to approximately a 40 to 50 degree turn. The butterfly wings 29, 31 closest to the head of the bed turn the patient's shoulders, and the butterfly wings 30, 32 closest to the foot of the bed, turn the patient's hips.

The turning bladder 36 includes air passages 33-34 connecting the wings 29-32 of the butterfly turning cells 37-38, the air passages 33-34 include a filling 35 inserted into each air passageway 33, 34 to keep an open, free flow of air, yet not too stiff that the patient would feel a lump when lying on it. The turning bladder 36 is constructed such that the air passages 33-34 do not close even if the patient is in a steep Fowler position (more than 45 degrees.) As a result, the butterfly structure of the turning bladder 36 allows the patient to turn at all angles.

To avoid entrapment, the outer edge of the turning bladder 36 is sized to extend beyond the flat horizontal dimension of the support surface, when inflated, to fill the void along the edge of the mattress. In addition, optional bolsters 41 are provided to help prevent entrapment. Further, they help cradle the patient 39 in the bed.

An air cell array 1 is provided which can be multiple air cell array sets 2, 3 extending laterally across the bed, with each air cell array 1 divided into at least two parts (left and right), such that all even on the left are connected, and all odd on the left are connected. Likewise, the same arrangement is made on the right side. For ease of illustration, the air cell array 1 is shown with laterally arranged air cell array sets 2, 3. However, those skilled in the art will recognize that air cell array sets 2, 3 can also be arranged as longitudinal air cells, with at least two zones (right and left) within which all air cells are connected to each other; such that these left and right zones can be controlled independently of each other to inflate or deflate.

The air pressure source can be programmed to provide multiple functions. For example, it can be programmed to perform continuous turning (lateral rotational therapy) at various angles and duration of turns using the same design of support surface, described herein, which provides a novel quick turn function.

The turn function can be improved as follows: when the left turn bladder 37 inflates, the right air cell array set 3 deflates, allowing for maximum and fastest turn. Likewise, when the right turn bladder 37 inflates, the left air cell array set 2 deflates. Alternatively, when the left turn bladder 37 inflates, both the right and the left air cell array sets 2, 3 may remain fully inflated, or the right air cell array set 3 may partially deflate to provide an even quicker turn, and a steeper turn. Of course, a turn in the opposite direction would use the same procedure.

Figure 5:
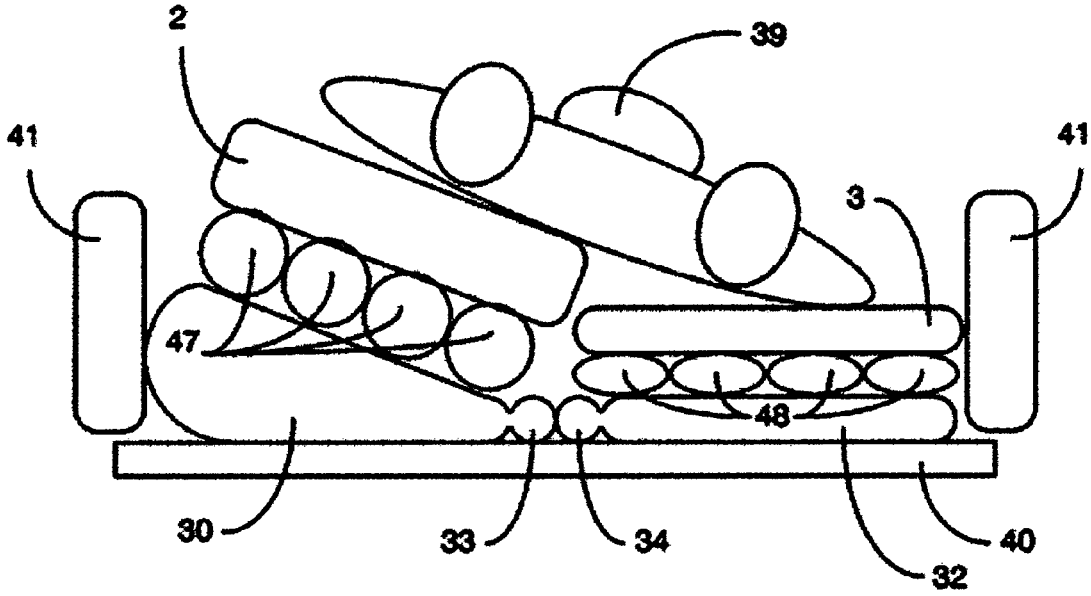
FIG. 5 illustrates and alternative preferred embodiment which has two air cell arrays, one arranged laterally, and the other arranged longitudinally.

FIG. 5 illustrates an alternative preferred embodiment of the invention. This embodiment uses a first air cell array 1 which includes air cell array sets 2, 3 and a second air cell array set which includes air cell array sets 47, 48. Air cell array sets 2, 3 have air cell array segments 4-25 that are arranged laterally. Air cell array sets 47, 48 have air cell array segments that are arranged longitudinally. This embodiment allows the patient 39 to be rotated to a steeper angle. Further, alternative pressure therapy can be applied laterally or longitudinally. When air cell array sets 47, 48 are inflated, they can be used to provide longitudinal alternating pressure therapy. If air cell array sets 47, 48 are deflated, air cell array sets 2, 3 can be used to provide lateral alternating pressure therapy. Of course, air cell array sets 47, 48 can be positioned above or below air cell array 1.

While the invention has been described with respect to a preferred embodiment thereof, it will be understood by those skilled in the art that various changes in detail may be made therein without departing from the spirit, scope, and teaching of the invention. For example, the number and shape of the turning bladder wings can vary, the materials used to fabricate the support surface can be anything suitable for its intended purpose, Accordingly, the invention herein disclosed is to be limited only as specified in the following claims.

We claim:

1. A support surface, comprising:

a pressurized air supply;

a controller operatively connected to, and controlling, the air supply;

a first air cell array defining a support surface plane, the first air cell array being inflated or deflated under control of the controller; and left and right turning bladders located under the first air cell array, each turning bladder including an upper body wing and a lower body wing and being inflatable or deflatable under control of the controller, wherein the upper body wing and the lower body wing of each turning bladder are connected to each other and to the pressurized air supply via a respective conduit, and wherein the conduits are oriented lengthwise in a middle of the support surface and between the left and right turning bladders in order to provide rapid inflation and deflation of the turning bladders, thereby facilitating the turning of a patient positioned on the first air cell array for providing various types of patient care and treatment, wherein the left and right turning bladders are independently inflatable and/or deflatable such that when one of the left and right turning bladders is inflated, and the other of the left and right turning bladders is deflated, a patient resting on the support surface is rotated, and wherein each of the upper body wings and the lower body wings of the left and right turning bladders is shell shaped in a bladder plane parallel to the support surface plane including a narrow section adjacent a center of the support surface and extending toward a side of the support surface and a wide section adjacent an outermost side of the support surface in order to minimize the amount of air required to inflate the turning bladders, thereby resulting in high-speed turning of the patient.

2. A support surface, as in claim 1, wherein:

the air cell array has left and right air cell array sets, each air cell array set is further comprised of a plurality of air cell array segments, the air cell array segments arranged continuously such they form a single air cell array set.

3. A support surface, as in claim 2, wherein:

the air cell array segments in each air cell array set are organized into at least two groups which are independently inflatable or deflatable under control of the pressurized air supply; and air pressure provided to each group is varied such that alternating pressure therapy can be provided to a patient resting on the support surface.

4. A support surface, as in claim 3, wherein:

the air cell array segments are arranged laterally.

5. A support surface, as in claim 3, further comprising:

a second air cell array positioned substantially above the first air cell array;

the second air cell array inflated and deflated under control of the pressurized air supply independent of the first air cell array;

the air cell array segments in the first and second air cell arrays are oriented both laterally, both longitudinally, or segments are oriented laterally in one air cell array and longitudinally in the other air cell array.

6. A support surface, as in claim 3, wherein:

the air cell array segments are arranged longitudinally.

7. A support surface, as in claim 3, wherein:

each air cell array set is independently inflatable or deflatable, such that the left or right air cell array set may be inflated while the other is deflated to increase the angle of rotation of the patient.

8. A support surface, as in claim 1, wherein the conduits are connected to the upper and lower body wings via the respective narrow sections of the upper and lower body wings.

9. A support surface, as in claim 8, further comprising a semi-rigid open weave material in each of the conduits.

* * * * *